US006319863B1

(12) United States Patent
Takeuchi et al.

(10) Patent No.: US 6,319,863 B1
(45) Date of Patent: Nov. 20, 2001

(54) WATER-DISINTEGRATABLE FIBROUS SHEET CONTAINING MODIFIED POLYVINYL ALCOHOL

(75) Inventors: Naohito Takeuchi; Takayoshi Konishi, both of Kagawa (JP)

(73) Assignee: Uni-Charm Corporation, Ehime (JP)

( * ) Notice: Subject to any disclaimer, the term of this patent is extended or adjusted under 35 U.S.C. 154(b) by 0 days.

(21) Appl. No.: 09/159,869

(22) Filed: Sep. 24, 1998

(30) Foreign Application Priority Data

Sep. 26, 1997 (JP) ..... 9-261974

(51) Int. Cl.[7] ..... B32B 27/30; B32B 9/04
(52) U.S. Cl. ..... 442/155
(58) Field of Search ..... 442/155

(56) References Cited

U.S. PATENT DOCUMENTS 3,438,808 * 4/1969 Hawkins et al. ..... 117/155
3,692,725 * 9/1972 Duchane ..... 260/29.6
4,172,930 * 10/1979 Kajitani et al. ..... 525/56
4,245,744 * 1/1981 Daniels et al. ..... 206/812
4,258,849 * 3/1981 Miller ..... 206/812
4,537,807 * 8/1985 Chan et al. ..... 428/74
5,252,332 * 10/1993 Goldstein ..... 424/402
5,387,638 * 2/1995 Nakamae et al. ..... 524/503
5,972,805 * 10/1999 Pomplun et al. ..... 442/59
5,986,004 * 11/1999 Pomplun et al. ..... 525/176

FOREIGN PATENT DOCUMENTS

H3-292924 A 12/1991 (JP) .
H6-198778 A 7/1994 (JP) .

* cited by examiner

*Primary Examiner*—Terrel Morris
*Assistant Examiner*—Norca L. Torres
(74) *Attorney, Agent, or Firm*—Koda & Androlia

(57) ABSTRACT

There is disclosed a fibrous sheet using a modified polyvinyl alcohol as a binder with which an aqueous solution containing a water-soluble organic salt, water-soluble inorganic salt and/or water-soluble boron compound is impregnated whereby wet strength of the fibrous sheet can be maintained. The fibrous sheet thus obtained is excellent in water-disintegratability and strength, and its water-disintegratability and strength are not lowered even at high temperatures. Furthermore, it is excellent in water-disintegratability even in cold water.

14 Claims, 4 Drawing Sheets

WATER-DISINTEGRATABLE FIBROUS SHEET CONTAINING MODIFIED POLYVINYL ALCOHOL

BACKGROUND OF THE INVENTION

1. Field of the Invention

The present invention relates to a water-disintegratable fibrous sheet that is easily dispersed by flushing water, and more particularly, relates to a water-disintegratable fibrous sheet that is excellent in water-disintegratability, strength, heat-resistance and water-disintegratability in cold water.

2. Description of the Prior Art

Fibrous sheets are used to cleanse human skin, e.g., skin around anus, and to clean a toilet room. The fibrous sheet is preferably water-disintegratable to be thrown away and drained in a toilet as it is. If it is not excellent in water-disintegratability, it requires a long time to be dispersed in a septic tank, and brings danger of clogging drainpipes of a toilet, when being thrown away and drained in a toilet. However, in general, a packed fibrous sheet impregnated with a cleansing liquid or the like has to be strong enough to endure conducting wiping operations while being impregnated with a cleansing liquid, and at the same time, has to keep its water-disintegratability in the event of being thrown away and drained in a toilet. Therefore, a water-disintegratable fibrous sheet that has good water-disintegratability and strength sufficient to use is demanded.

Japanese Laid-Open Patent H3-292924 discloses a water-disintegratable cleaning product composed of fibers containing polyvinyl alcohol impregnated with an aqueous solution of boric acid. Japanese Laid-Open Patent H6-198778 discloses a water-disintegratable sanitary napkin composed of non-woven fabric containing polyvinyl alcohol added with boric ion and bicarbonic ion. In these inventions, fibrous sheets are produced by binding each fiber using properties such that boric acid cross-links polyvinyl alcohol. However, a large amount of binder, i.e., polyvinyl alcohol, is required to produce fibrous sheets having strength sufficient to use.

Furthermore, miscellaneous products, including such water-disintegratable products, are often left in a vehicle or a warehouse during their transportation and storage, and the temperatures in such a closed space rise above the outer atmospheric temperature. In the case where they are stored in a house, they may be possibly left under a temperature of 40° C. or higher in the middle of summer. When water-disintegratable fibrous sheets which are previously impregnated are packed as finished products and then shipped to market, water-disintegratability and strength of the fibrous sheets are remarkably deteriorated if they are left under high temperature circumstances. Therefore, a water-disintegratable fibrous sheet has to retain its water-disintegratability and strength even under high temperature circumstances, that is, its heat-resistance is important. However, there is no report relating to the heat-resistance in the water-disintegratable cleaning products and the water-disintegratable non-woven fabric disclosed in the preceding publications.

Water temperatures are generally lower than the atmospheric temperature though they vary depending on seasons. When a fibrous sheet is thrown away and drained in a toilet after used, it has to be disintegrated in water at a temperature lower than the atmospheric temperature, i.e., in cold water. However, as to the fibrous sheet using polyvinyl alcohol as a binder, its water-disintegratability is generally enhanced in response to a rise in temperatures of water, but deteriorated in response to a fall in temperatures of water.

SUMMARY OF THE INVENTION

An object of the present invention is to provide a fibrous sheet having good water-disintegratability and sufficient strength to withstand practical use.

Another object of the present invention is to provide a water-disintegratable fibrous sheet that is excellent in heat-resistance.

Still another object of the present invention is to provide a water-disintegratable fibrous sheet that is excellent in water-disintegratability even in cold water.

The present inventors have found that a water-disintegratable fibrous sheet using a modified polyvinyl alcohol is excellent in water-disintegratability, strength, heat-resistance and water-disintegratability in cold water.

The present invention is to provide a water-disintegratable fibrous sheet comprising water-dispersible fibers, which sheet contains at least one binder selected from the group consisting of a sulfonic acid-modified polyvinyl alcohol and a carboxylic acid-modified polyvinyl alcohol, and at least one compound selected from the group consisting of a water-soluble organic salt, a water-soluble inorganic salt and a boron compound being incorporated in the sheet.

In the fibrous sheet using these modified polyvinyl alcohols, sufficient strength to withstand practical use such as wiping operation can be maintained even in a wet state, for example, in a state of impregnating a cleaning liquid drug therein. Further, when it is exposed to a large amount of water, the fibers of the fibrous sheet are dispersed in water, so that water-disintegratability is exhibited.

DESCRIPTION OF THE PREFERRED EMBODIMENTS

Figure 1:
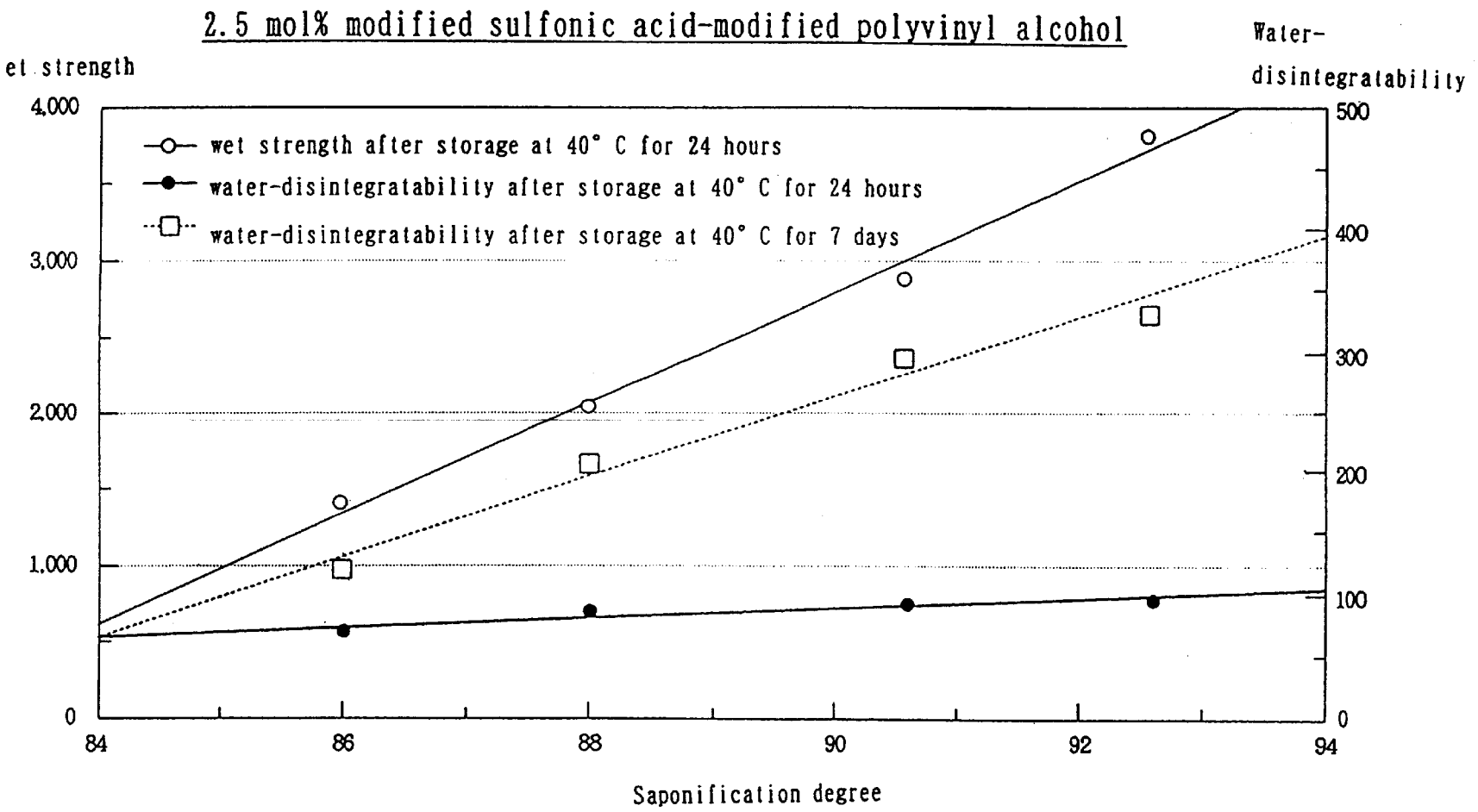
FIG. 1 is a graph showing the relationship of a saponification degree of a 2.5 mol % modified sulfonic acid-modified polyvinyl alcohol with the water-disintegratability and wet strength after storage at 40° C. for 24 hours as well as the water-disintegratability after storage at 40° C. for 7 days in Example 3.

In the fibrous sheet of the present invention, fibers having good dispersibility in water are used. The term "dispersibility in water" used herein has the same meaning as water-disintegratability, i.e., the properties such that it is divided into minute parts upon contacting with a large amount of water.

One or both of natural fibers and chemical fibers can be used as the fibers contained in the water-disintegratable fibrous sheet of the present invention. Examples of the natural fibers include wood pulp, and examples of the chemical fibers include rayon as a regenerated fiber and polypropylene as a synthetic fiber. With using these fibers as a main component, the fibers may further contain natural fibers such as cotton, rayon, synthetic fibers such as polypropylene, polyvinyl alcohol, polyester and polyacrylonitrile, synthetic pulp made of polyethylene and the like, and inorganic fibers such as glass wool.

The basis weight of the fibers used in the fibrous sheet of the present invention is preferably 20 to 100 g/m$^2$. If the basis weight is less than the lower limit, the strength cannot be obtained which is necessary for a wiping operation. Also, if the basis weight is less than the lower limit, when a modified polyvinyl alcohol is coated on a surface of a fiber web forming the fibrous sheet, the fibrous sheet becomes stiff, and resulting in lowering of softness. On the other hand, if the basis weight is more than the upper limit, flexibility desirable as a fibrous sheet is lost. Also, if the basis weight is more than the upper limit, a large amount of the modified polyvinyl alcohol is required, so that it is uneconomical. When the fibrous sheet of the present invention is used for a wiping operation, the basis weight of the fibers is more preferably 30 to 70 g/m$^2$ from the viewpoint of strength and softness.

The fibrous sheet of the present invention can be produced by any of a dry laid process and a wet laid process that are conventionally practiced in the art. For example, when the fibrous sheet is produced by the wet laid process, a fiber web produced is dried, and then modified polyvinyl alcohol as a binder is coated by a silk-screen process or the like. Alternatively, the binder may be mixed at the time of forming the fiber web. The fiber web is a sheet-formed lump of fibers wherein the directions of the fibers are arranged to some extent. In the fibrous sheet thus obtained, the binding among the fibers is reinforced by the modified polyvinyl alcohol.

The modified polyvinyl alcohol of the present invention is a vinyl alcohol series polymer containing a sulfonic acid group or a carboxyl group with a predetermined amount, and the former is called as a sulfonic acid-modified polyvinyl alcohol and the latter a carboxylic acid-modified polyvinyl alcohol. In the following, a unit containing a sulfonic acid group or a carboxyl group is represented by X.

A monomer having a sulfonic acid group may include ethylene sulfonic acid, allylsulfonic acid, methallylsulfonic acid, 2-acrylamide-2-methylpropanesulfonic acid and salts thereof, etc. A compound having a sulfonic acid group may include an aldehyde derivative having a sulfonic acid group such as p-sulfonic acid benzaldehyde and salts thereof, etc., and said group can be incorporated therein by the acetal reaction conventionally known in the art.

A monomer having a carboxyl group may include fumaric acid, maleic acid, itaconic acid, maleic anhydride, phthalic anhydride, trimellitic anhydride, acrylic acid and salts thereof; an acrylic acid ester such as methyl acrylate, etc.; and a methacrylic acid ester such as methyl methacrylate, etc. A compound having a carboxyl group may include a monomer such as acrylic acid, etc. and said group can be incorporated therein by the Michael addition reaction conventionally known in the art.

In the present invention, the binder is preferably the sulfonic acid-modified polyvinyl alcohol in the viewpoint of water-disintegratability and strength of the fibrous sheet.

The modification degree of the modified polyvinyl alcohol to be used in the present invention is a molar ratio of X contained in a copolymer of the modified polyvinyl alcohol. Among the modified polyvinyl alcohols, it is a molar equivalent of X based on the molar equivalent of the polyvinyl alcohol, the molar equivalent of vinyl acetate and the molar equivalent of X. For example, when the modified polyvinyl alcohol is represented by the following chemical formula 1:

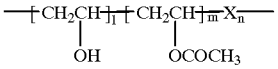

wherein "l" represents a molar equivalent of the vinyl alcohol, "m" represents a molar equivalent of the vinyl acetate and "n" represents a molar equivalent of X, the modification degree is represented by the following formula:

$$Modification\ degree = \frac{n}{l+m+n} \times 100$$

The higher the modification degree is, the better the water-disintegratability is. On the other hand, however, the strength of the fibrous sheet is lowered. Thus, the modification degree of the modified polyvinyl alcohol is preferably 1.0 to 10.0 mol %, in the viewpoint of practical use of the fibrous sheet. The modification degree is more preferably 2.0 to 5.0 mol %.

There are many kinds of modified polyvinyl alcohols having various saponification degrees and polymerization degrees.

With respect to the saponification degree of the modified polyvinyl alcohol used in the present invention, it is not particularly limited since it depends on a compound to be added and a modified amount of the modified polyvinyl alcohol. However, the saponification degree of the modified polyvinyl alcohol is preferably 80 to 98% to effectively develop the effects of the present invention. In the present invention, a modified polyvinyl alcohol having a specific saponification degree can be used alone or two or more modified polyvinyl alcohols having different specific saponification degrees can be used in combination. If the saponification degree is low, strength of the water-disintegratable fibrous sheet is lowed. That is, when it is used for a wiping operation, the fibrous sheet is liable to be broken. Also, if the saponification degree is large, strength is heightened, but water-disintegratability is lowered. The saponification degree is more preferably 86 to 98% from the viewpoint of water-disintegratability and strength.

In the present invention, the preferable saponification degree varies depending on the modification degree of the modified polyvinyl alcohol. When a water-disintegratable fibrous sheet is prepared by using nonwoven fabric, the modification degree of the sulfonic acid-modified polyvinyl alcohol is preferably 1.0 to 10.0 mol %, and the saponification degree of the sulfonic acid-modified polyvinyl alcohol at this time is preferably 80 to 98%.

The modification degree of the sulfonic acid-modified polyvinyl alcohol is more preferably 2.0 to 5.0 mol %, and the saponification degree of the sulfonic acid-modified polyvinyl alcohol at this time is preferably 86 to 98%.

Also, when the modification degree of the sulfonic acid-modified polyvinyl alcohol is 1.0 to 2.0 mol %, the saponification degree of the sulfonic acid-modified polyvinyl alcohol is preferably 84 to 90%. Further, when the modification degree of the sulfonic acid-modified polyvinyl alcohol is 2.0 to 3.0 mol %, the saponification degree of the sulfonic acid-modified polyvinyl alcohol is preferably 86 to 95%. Still further, when the modification degree of the sulfonic acid-modified polyvinyl alcohol is 3.0 to 5.0 mol %, the saponification degree of the sulfonic acid-modified polyvinyl alcohol is preferably 92 to 98%.

On the other hand, the polymerization degree of the modified polyvinyl alcohol is preferably about 100 to 8000 in terms of the viscosity average polymerization degree. If the polymerization degree is lower than the lower limit, strength of the fibrous sheet becomes insufficient because it cannot exhibit the properties of the binder that reinforces the connection among the fibers. If the polymerization degree is more than the upper limit, its excessively high viscosity disadvantageously prevents uniform coating onto the fibrous sheet on production. Furthermore, the resulting fibrous sheet lacks softness and becomes hard and stiff to the touch, and therefore is difficult to be used as a commercial product. The polymerization degree is more preferably about 500 to 4000 from the viewpoint of water-disintegratability and softness of the water-disintegratable fibrous sheet, particularly preferably about 1000 to 2500.

The amount (coated amount) of the modified polyvinyl alcohol is preferably 3 to 30 g per 100 g of the fibers. If the amount is less than the lower limit, strength of the fibrous sheet is lowered. If the amount is more than the upper limit, the fibrous sheet becomes stiff and has lowered softness, resulting in deteriorated feeling on use. In this case, the amount of the modified polyvinyl alcohol is more preferably 5 to 20 g per 100 g of the fibers from the viewpoint of water-disintegratability and softness.

Incidentally, in the water-disintegratable fibrous sheet of the present invention, a polyvinyl alcohol which is not modified can be used in combination with the modified polyvinyl alcohol.

In the following, a fibrous sheet at the state that the modified polyvinyl alcohol is coated is called as a modified polyvinyl alcohol coated paper.

In the present invention, at least one compound selected from the group consisting of a water-soluble organic salt, a water-soluble inorganic salt and a boron compound is contained in the fibrous sheet to prevent the modified polyvinyl alcohol in the fibrous sheet from being dissolved in a small amount of water before or during use.

The fibrous sheet of the present invention can be used for a wiping operation at the dried state as well as the wet state. However, when these compounds are contained in the fibrous sheet, the fibrous sheet becomes excellent particularly when the fibrous sheet is used in the wet state. That is, during the wiping operation by using the fibrous sheet, the fibrous sheet is not water-disintegratable by the water component contained therein and has wet strength sufficient to endure the wiping operation.

The water-soluble organic acid can subject the modified polyvinyl alcohol to salting out. The organic acid is preferably at least one carboxylate selected from the group consisting of sodium tartrate, potassium tartrate, sodium citrate, potassium citrate, sodium malate and potassium malate. These are excellent in water-solubility and have no danger of exerting harmful influence on human bodies. Among these, tartrates such as sodium tartrate and potassium tartrate are particularly preferably used. Water-disintegratability, strength, heat-resistance and water-disintegratability in cold water of the fibrous sheet can further be improved by using tartrates.

When the organic salt is the carboxylate, and the carboxylate is selected from sodium tartrate, potassium tartrate, sodium citrate, potassium citrate, sodium malate and potassium malate, it is preferred that the carboxylate is present in an amount of 2.5 g or more per 100 g of the modified polyvinyl alcohol coated paper (fibrous sheet containing the modified polyvinyl alcohol). For example, 100 g of the modified polyvinyl alcohol coated paper is impregnated with 250 g of an aqueous solution having a carboxylate concentration of 1.0% by weight or more. If the amount of the carboxylate is less than the above amount, strength in the wet state is insufficient and water-disintegratability is deteriorated. In such a case, strength can be improved by increasing the amount of the modified polyvinyl alcohol to be coated on the fibrous sheet. However, if the amount of the modified polyvinyl alcohol is excessive, the softness of the resulting fibrous sheet is lowered. It is more preferred that the carboxylate is present in an amount of 5.0 g or more per 100 g of the modified polyvinyl alcohol coated paper. In the fibrous sheet, the higher the content of the carboxylate is, the better water-disintegratability and strength are. Therefore, when the saponification degree of the modified polyvinyl alcohol is low, strength of the water-disintegratable fibrous sheet can be improved by increasing the amount of the carboxylate. While the upper limit of the amount of the carboxylate is not particularly limited, it is preferred that the carboxylate is present in an amount of 50.0 g or less per 100 g of the modified polyvinyl alcohol coated paper from the view point of economic reasons. However it was found that when 100 g of the modified polyvinyl alcohol coated paper was impregnated with 250 g of an aqueous solution, the carboxylate concentration of 40% by weight exhibited excellent results in both water-disintegratability and strength.

In the fibrous sheet of the present invention, a water-soluble inorganic salt can be used in place of the above-mentioned organic acid. The inorganic salt can also cause a salting out reaction to the modified polyvinyl alcohol so that it prevents the modified polyvinyl alcohol from dissolving in a small amount of water. The inorganic salt is not particularly limited so long as it can cause a salting out reaction. Examples of the inorganic salt may include potassium sulfate, ammonium sulfate, zinc sulfate, copper sulfate, iron sulfate, magnesium sulfate, aluminum sulfate, potash alum, ammonium nitrate, sodium nitrate, potassium nitrate, aluminum nitrate, sodium chloride, potassium chloride and the like. In the present invention, potassium sulfate and/or sodium sulfate is/are particularly preferred in the viewpoint of wet strength of the fibrous sheet.

It is preferred that the inorganic salt is present in an amount of 2.5 to 50.0 g per 100 g of the modified polyvinyl alcohol coated paper. For example, 100 g of the modified polyvinyl alcohol coated paper is impregnated with 250 g of an aqueous solution having an inorganic salt concentration of 1.0% by weight or more.

Furthermore, in the fibrous sheet of the present invention, a water-soluble boron compound can be used in place of the above-mentioned organic salt or inorganic salt. The boron compound causes a cross-linking reaction with the modified polyvinyl alcohol so that it prevents the modified polyvinyl alcohol from being dissolved in a small amount of water. The boron compound is preferably at least one compound selected from the group consisting of boric acid and borax. These boron compounds are present in an amount of 0.25 to 12.5 g per 100 g of the modified polyvinyl alcohol coated paper. For example, 100 g of the modified polyvinyl alcohol coated paper is impregnated with 250 g of an aqueous solution having a boron compound concentration of 0.1% by weight or more.

The fibrous sheet of the present invention may be impregnated with only one compound of the water-soluble organic salt, the water-soluble inorganic salt and the water-soluble boron compound but it is also possible to be impregnated with two or more compounds in combination.

Incidentally, it is an essential requirement in the present invention that those compounds are water-soluble. This is based on the limitation on use of the water-disintegratable fibrous sheet. When the fibrous sheet is disposed in water, the compounds have to be dissolved in water to make the fibrous sheet to exhibit water-disintegratability. However, a water-solubility of the compound may be changed variously, as long as it is water-soluble and the fibrous sheet does not exert a harmful influence to sewage disposal or drainage when it is disposed in a drainage conduit or the like. That is, it is not necessary for the compounds to have a particularly excellent water-solubility.

The water-disintegratable fibrous sheet obtained by the above manner does not suffer from deterioration in its water-disintegratability and strength even if it is stored in circumstances of higher temperatures than the ordinary atmospheric temperature, for example, at 40° C.

Furthermore, it does not suffer from deterioration in its water-disintegratability even in water at lower temperatures than the ordinary atmospheric temperature. For example, the water-disintegratability in water at 10° C. is not substantially changed from the water-disintegratability in water at 20° C.

In the water-disintegratable fibrous sheet of the present invention, another materials may be added if they do not spoil the effects of the present invention. For example, a surfactant, a disinfectant, a preservative, a deodorizer, a moistening agent, an alcohol and the like can be added. These materials can be added to the aqueous solution in which the water-soluble organic salt, the water-soluble inorganic salt and/or the water-soluble boron compound to be added to the fibrous sheet is/are dissolved, to prepare the fibrous sheet.

The water-disintegratable fibrous sheet of the present invention can be used as wet-type tissue paper applied to human skin, for example, skin around anus, and can be used as a wiping sheet for cleaning a toilet room. If the water-disintegratable fibrous sheet of the present invention is packed as a product previously wetted, it is sold by sealed up to prevent the fibrous sheet from drying.

Alternatively, the water-disintegratable fibrous sheet of the present invention can be sold in a dry state. For example, the modified polyvinyl alcohol coated paper is impregnated with an aqueous solution containing the organic salt, the inorganic salt and/or the boron compound and is then followed by drying, to obtain a dried water-disintegratable fibrous sheet. The dried water-disintegratable fibrous sheet thus obtained may be impregnated with a liquid drug or water upon use.

The present invention will be described in more detail below with reference to various examples, but the invention is not construed as being limited to these examples.

EXAMPLE 1

By using 100% of bleached Kraft pulp of conifer (an amount of filtered water due to Canadian Standard Freeness (CFS) test: 740 ml) as a raw material fiber, a base fibrous sheet having a basis weight of 50 g/m$^2$ was prepared by a wet laid process by using a paper machine with round mesh. After drying the base fibrous sheet, 10 g/m$^2$ of sulfonic acid-modified polyvinyl alcohol was coated on the surface of the base fibrous sheet to prepare a modified polyvinyl alcohol coated paper. As a method of coating, the sulfonic acid- modified polyvinyl alcohol was uniformly coated on the base fibrous sheet by using a silk-screen (60 mesh). After coating, it was dried at 170° C. for 2 minutes by using a hot air stream dryer. The sulfonic acid-modified polyvinyl alcohol used had a modification degree of 3.0 mol %, a saponification degree of 93.1% and a polymerization degree of 1150.

The modified polyvinyl alcohol coated paper obtained by the above-described manner was impregnated with an aqueous solution in which sodium tartrate was dissolved in water to make a concentration of 18.0% by weight, in an amount of 250 g per 100 g of the modified polyvinyl alcohol coated paper, to obtain a fibrous sheet. Also, the modified polyvinyl alcohol coated paper obtained by the above-described manner was impregnated with an aqueous solution in which sodium sulfate was dissolved in water to make a concentration of 12.0% by weight, in an amount of 250 g per 100 g of the modified polyvinyl alcohol coated paper, to obtain a fibrous sheet. The resulting respective fibrous sheets as examples of the present invention were subjected to the test of water-disintegratability, wet strength, heat-resistance and water-disintegratability in cold water.

The test of water-disintegratability was conducted according to the test of water-disintegratability of toilet paper regulated under JIS P4501 (Japanese Industrial Standard) and disintegratability of the fibrous sheet was measured in water stream at a water temperature of 20±5° C. (In the Tables, the results are shown in terms of second.) Specifically, a specimen obtained by cutting the above-obtained fibrous sheet into a square of 10 cm×10 cm was put in a beaker containing 300 ml of ionexchanged water, followed by stirring with a rotor. The rotational speed was 600 r.p.m. The state of dispersion of the fibrous sheet was continuously observed, and the time required for completion of dispersion was measured.

Wet strength was measured in such a manner that the above-obtained fibrous sheet was cut to a test piece having a dimension of 25 mm width and 150 mm length, and strength of the test piece was measured with a Tension test machine at a chuck distance of 100 mm and a tensile speed of 100 mm/min. Strength at breakage (gf) was taken as a test result of wet strength. (In the Tables, the results are shown in terms of g/25 mm.)

For the test of heat-resistance, the above-obtained fibrous sheet was sealed up in a polypropylene envelope and then placed in a polyethylene container, and was stored at an atmosphere of 40° C. for 24 hours. After the storage, the fibrous sheet was subjected to the above-described tests for water-disintegratability and wet strength.

The test of water-disintegratability in cold water was conducted according to the same method as in the test of water-disintegratability of toilet paper regulated under JIS P4501 (Japanese Industrial Standard) and disintegratability of the above-obtained fibrous sheet was measured in water stream at a water temperature of 10° C. (In the Tables, the results are shown in terms of second.)

Comparative examples were prepared in the same manner as in the above-mentioned method. The same base fibrous sheet as in Example was coated by using a polyvinyl alcohol (the saponification degree of 88%, and the average polymerization degree of 1700, "PVA-217" (trade name) available from Kuraray Co., Ltd.) in place of the sulfonic acid-modified polyvinyl alcohol of Example, to obtain a polyvinyl alcohol coated paper. The coated amount of the polyvinyl alcohol was 10 g/m$^2$ based on the base fibrous sheet. Also, aqueous solutions containing borax, sodium sulfate and sodium tartrate respectively were prepared. The concentrations thereof are 0.8% by weight, 12.0% by weight and 18.0% by weight, respectively. The polyvinyl alcohol coated paper thus prepared was impregnated each of the aqueous solutions in an amount of 250 g per 100 g of the polyvinyl alcohol coated paper, to obtain a fibrous sheet. The resulting fibrous sheets as comparative examples were subjected to the test of water-disintegratability, wet strength, heat-resistance and water-disintegratability in cold water in the same manner as in Example.

The results obtained are shown in Table 1.

TABLE 1

| | Comparative Example Polyvinyl Alcohol | | | Example Sulfonic acid-modified polyvinyl alcohol | |
|---|---|---|---|---|---|
| | borax | Sodium sulfate | Sodium tartrate | Sodium tartrate | Sodium sulfate |
| Concentration (% by weight) | 0.8 | 12.0 | 18.0 | 18.0 | 12.0 |
| Water-disintegratability (second) | 182 | 330 | 132 | 63 | 95 |
| Wet strength (g/25 mm) | 2511 | 2113 | 3121 | 2430 | 1874 |
| After storage 40° C. for 24 hours | | | | | |
| Water-disintegratability (second) | 226 | 563 | 159 | 118 | 142 |
| Wet strength (g/25 mm) | 612 | 1852 | 2956 | 2105 | 1771 |
| Water-disintegratability in cold water (second) | 320 | 540 | 162 | 102 | 151 |

It is understood from the results of Table 1 that in the fibrous sheet containing the sulfonic acid-modified polyvinyl alcohol, strength was not lowered even after storage at 40° C. for 24 hours. Also, in the fibrous sheet using the sulfonic acid-modified polyvinyl alcohol, its water-disintegratability was good and the water-disintegratability in cold water was also excellent.

EXAMPLE 2

A sulfonic acid-modified polyvinyl alcohol coated paper was prepared in the same manner as in Example 1. Aqueous solutions containing sodium citrate, potassium tartrate and sodium tartrate respectively as carboxylates were prepared. The concentrations of the respective solutions were each 18% by weight. The modified polyvinyl alcohol coated paper was impregnated with each of the aqueous solutions in an amount of 250 g per 100 g of the modified polyvinyl alcohol coated paper, to obtain a fibrous sheet.

The fibrous sheets thus obtained were measured in water-disintegratability, wet strength, and water-disintegratability and wet strength after storage at 40° C. for 24 hours. The measurement methods are the same as in Example 1.

Moreover, in order to observe heat-resistance after storage for a long period of time under high temperature, the resulting fibrous sheet was sealed up in a polypropylene envelope and then placed in a polyethylene container, and after stored at an atmosphere of 40° C. for 7 days, water-disintegratability and wet strength were measured. The measurement methods are the same as in Example 1.

As a comparative example, a polyvinyl alcohol coated paper was prepared in the same manner as in Comparative example of Example 1 by using the polyvinyl alcohol in place of the sulfonic acid-modified polyvinyl alcohol. The resulting polyvinyl alcohol coated paper was impregnated with a solution prepared by dissolving sodium tartrate in water to make the concentration 18.0% by weight in an amount of 250 g per 100 g of the polyvinyl alcohol coated paper, to obtain a fibrous sheet. The fibrous sheet thus obtained was measured in water-disintegratability, wet strength, water-disintegratability and wet strength after storage at 40° C. for 24 hours and water-disintegratability and wet strength after storage at 40° C. for 7 days in the same manner as in Example 2.

The results obtained are shown in Table 2.

TABLE 2

| | Comparative Example Polyvinyl alcohol Sodium tartrate | Example Sulfonic acid-modified polyvinyl alcohol Sodium tartrate |
|---|---|---|
| Concentration (% by weight) | 18.0 | 18.0 |
| Water-disintegratability (second) | 132 | 63 |
| Wet strength (g/25 mm) | 3121 | 2430 |
| After storage 40° C. for 24 hours | | |
| Water-disintegratability (second) | 159 | 118 |
| Wet strength(g/25 mm) | 2956 | 2105 |
| After storage 40° C. for 7 days | | |
| Water-disintegratability (second) | >900 | 170 |
| Wet strength(g/25 mm) | 2984 | 2105 |

It is understood from the results of Table 2 that the fibrous sheet containing the sulfonic acid-modified polyvinyl alcohol is less deteriorated in water-disintegratability after storage at 40° C. for 7 days as compared with that of the comparative example.

EXAMPLE 3

A base fibrous sheet was prepared in the same manner as in Example 1. Various kinds of the sulfonic acid-modified polyvinyl alcohols or the carboxylic acid-modified polyvinyl alcohols were coated on the base fibrous sheet in the same manner as in Example 1. Various kinds of the sulfonic acid-modified polyvinyl alcohols or the carboxylic acid-modified polyvinyl alcohols were each different in the modification degree, the saponification degree and the polymerization degree. An aqueous solution was prepared by dissolving sodium tartrate in water to make the concentration 18.0% by weight. The modified polyvinyl alcohol coated papers thus obtained were impregnated with this aqueous solution each in an amount of 250 g per 100 g of the modified polyvinyl alcohol coated paper. The fibrous sheets thus obtained were measured in water-disintegratability, wet strength, water-disintegratability and wet strength after storage at 40° C. for 24 hours and water-disintegratability and wet strength after storage at 40° C. for 7 days. The measurement methods are the same as in Example 2.

As a comparative example, a polyvinyl alcohol coated paper was prepared in the same manner as in Comparative example of Example 1 by using the polyvinyl alcohol in place of the modified polyvinyl alcohols. The resulting polyvinyl alcohol coated paper was impregnated with a solution prepared by dissolving sodium tartrate in water to make the concentration 18.0% by weight in an amount of 250 g per 100 g of the polyvinyl alcohol coated paper. The fibrous sheet thus obtained was measured in water-disintegratability, wet strength, water-disintegratability and wet strength after storage at 40° C. for 24 hours and water-disintegratability and wet strength after storage at 40° C. for 7 days in the same manner as in Example 2.

The results obtained are shown in Table 3.

TABLE 3

| | Comparative Example | Example sulfonic acid-modified polyvinyl alcohol | | | | | | |
|---|---|---|---|---|---|---|---|---|
| Modification degree (mol %) | 0.0 | 1.5 | 1.5 | 1.5 | 1.5 | 2.0 | 2.0 | 2.0 |
| Saponification degree (%) | 88.0 | 82.0 | 84.0 | 88.0 | 91.8 | 84.0 | 88.0 | 92.0 |
| Polymerization degree | 1700 | 1600 | 1600 | 1600 | 1600 | 1700 | 1700 | 1700 |
| Water-disintegratability (second) | 132 | 70 | 114 | 141 | 210 | 25 | 54 | 126 |
| Wet Strength (g/25 mm) | 3121 | 1500 | 2200 | 3760 | >5000 | 634 | 1747 | 2861 |
| After storage 40° C. for 24 hours | | | | | | | | |
| Water-disintegratability (second) | 159 | 114 | 177 | 182 | 258 | 31 | 153 | 159 |
| Wet strength (g/25 mm) | 2956 | 1215 | 2169 | 3325 | >5000 | 591 | 1827 | 2684 |
| After storage 40° C. for 7 days | | | | | | | | |
| Water-disintegratability (second) | >600 | >600 | >600 | >600 | >600 | 36 | 178 | 423 |
| Wet strength (g/25 mm) | 2280 | 1141 | 2141 | 3279 | >5000 | 588 | 1357 | 2611 |

| Example sulfonic acid-modified polyvinyl alcohol | | | | | | | | |
|---|---|---|---|---|---|---|---|---|
| 2.5 | 2.5 | 2.5 | 2.5 | 3.0 | 3.0 | 3.0 | 3.0 | 3.0 |
| 86.0 | 88.0 | 90.6 | 92.6 | 88.0 | 90.5 | 92.2 | 93.1 | 94.1 |
| 1600 | 1600 | 1600 | 1600 | 1150 | 1100 | 1150 | 1100 | 1150 |
| 32 | 40 | 49 | 53 | 30 | 43 | 47 | 63 | 66 |
| 1435 | 2105 | 3021 | 3920 | 887 | 1225 | 1858 | 2430 | 3498 |
| 69 | 88 | 94 | 96 | 42 | 81 | 88 | 118 | 168 |
| 1387 | 2032 | 2887 | 3805 | 845 | 972 | 1426 | 2105 | 2588 |
| 119 | 210 | 298 | 332 | 81 | 160 | 180 | 191 | 195 |
| 1288 | 1977 | 2774 | 3585 | 827 | 1225 | 1177 | 1955 | 3130 |

| Example sulfonic acid-modified polyvinyl alcohol | | | | | | | | |
|---|---|---|---|---|---|---|---|---|
| 3.0 | 4.0 | 4.0 | 4.0 | 4.0 | 5.0 | 5.0 | 5.0 | 10.0 |
| 95.5 | 93.4 | 95.0 | 96.8 | 97.9 | 95.2 | 96.6 | 98.0 | 99.5 |
| 1150 | 1200 | 1200 | 1200 | 1200 | 1130 | 1130 | 1130 | 1100 |
| 89 | 21 | 28 | 49 | 73 | 41 | 42 | 83 | 32 |
| 4385 | 448 | 964 | 1845 | 4517 | 673 | 1252 | 2130 | 370 |
| 216 | 45 | 51 | 96 | 138 | 39 | 47 | 121 | 35 |
| 3846 | 343 | 721 | 1600 | 3948 | 673 | 1120 | 2011 | 383 |
| 468 | 40 | 41 | 180 | >600 | 51 | 80 | 211 | 35 |
| 3616 | 415 | 977 | 1545 | 4471 | 873 | 1435 | 1984 | 468 |

| | Example carboxylic acid-modified polyvinyl alcohol | | | | | |
|---|---|---|---|---|---|---|
| Modification degree (mol %) | 1.0 | 1.0 | 1.0 | 2.0 | 2.0 | 2.0 |
| Saponification degree (%) | 80.0 | 84.0 | 88.0 | 82.0 | 88.0 | 90.0 |
| Polymerization degree | 1800 | 1800 | 1800 | 1800 | 1800 | 1800 |
| Water-disintegratability (second) | 71 | 84 | 139 | 59 | 75 | 94 |
| Wet strength (g/25 mm) | 1141 | 2100 | 4328 | 1258 | 2483 | 3284 |
| After storage 40° C. for 24 hours | | | | | | |
| Water-disintegratability (second) | 149 | 259 | >600 | 110 | 170 | 291 |
| Wet strength (g/25 mm) | 1069 | 2040 | 4245 | 1145 | 2263 | 3047 |
| After storage 40° C. for 7 days | | | | | | |
| Water-disintegratability (second) | 244 | >600 | >600 | 411 | 518 | >600 |
| Wet strength (g/25 mm) | 1007 | 1944 | 3499 | 1088 | 1862 | 2856 |

[As for FIG. 1]

FIG. 1 is a graph showing the relationship of a saponification degree of a sulfonic acid-modified polyvinyl alcohol with the water-disintegratability and wet strength after storage at 40° C. for 24 hours as well as the water-disintegratability after storage at 40° C. for 7 days in the results of Example 3 carried out by using a 2.5 mol % modified sulfonic acid-modified polyvinyl alcohol.

From FIG. 1, the following were found in the fibrous sheet of Example 3 using a 2.5 mol % modified sulfonic acid-modified polyvinyl alcohol.

In order to obtain the results of the water-disintegratability being 200 seconds or less and the strength being 1000 g/25 mm after storage at 40° C. for 24 hours, the saponification degree of the polyvinyl alcohol is preferably 86% or more. Also, in order to obtain the results of the water-disintegratability being 400 seconds or less after storage at 40° C. for 7 days, the saponification degree of the polyvinyl alcohol is preferably 91% or less.

The saponification degree at this time is preferably 86 to 91%.

Figure 2:
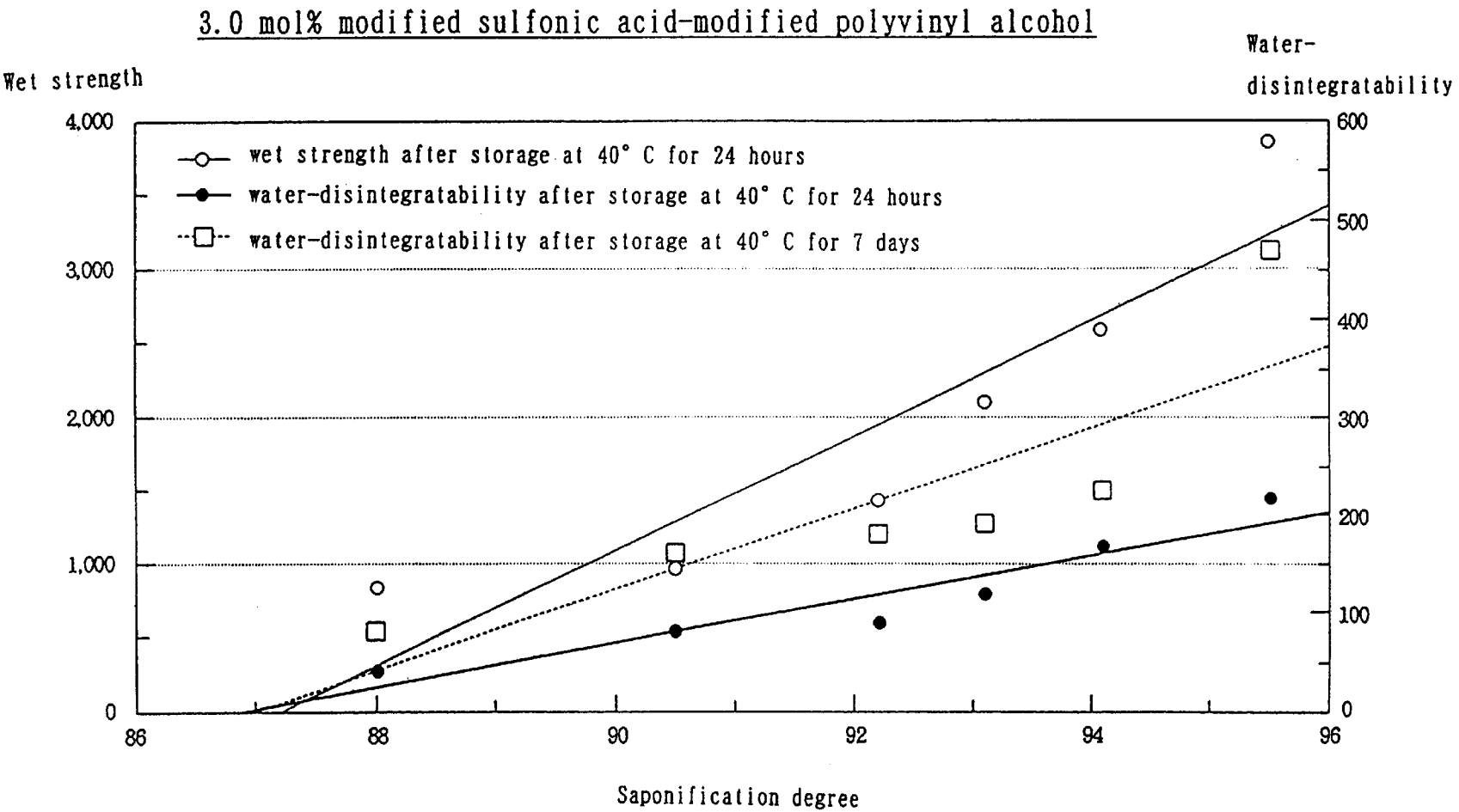
FIG. 2 is a graph showing the relationship of a saponification degree of a 3.0 mol % modified sulfonic acid-modified polyvinyl alcohol with the water-disintegratability and wet strength after storage at 40° C. for 24 hours as well as the water-disintegratability after storage at 40° C. for 7 days in Example 3.

[As for FIG. 2]

Also, FIG. 2 is a graph showing the relationship of a saponification degree of a sulfonic acid-modified polyvinyl alcohol with the water-disintegratability and wet strength after storage at 40° C. for 24 hours as well as the water-disintegratability after storage at 40° C. for 7 days in the results of Example 3 carried out by using a 3.0 mol % modified sulfonic acid-modified polyvinyl alcohol.

From FIG. 2, the following were found in the fibrous sheet of Example 3 using a 3.0 mol % modified sulfonic acid-modified polyvinyl alcohol.

In order to obtain the results of the water-disintegratability being 200 seconds or less and the strength being 1000 g/25 mm after storage at 40° C. for 24 hours, the saponification degree of the polyvinyl alcohol is preferably 90% or more. Also, in order to obtain the results of the water-disintegratability being 400 seconds or less after storage at 40° C. for 7 days, the saponification degree of the polyvinyl alcohol is preferably 95% or less.

The saponification degree at this time is preferably 88 to 94%.

Figure 3:
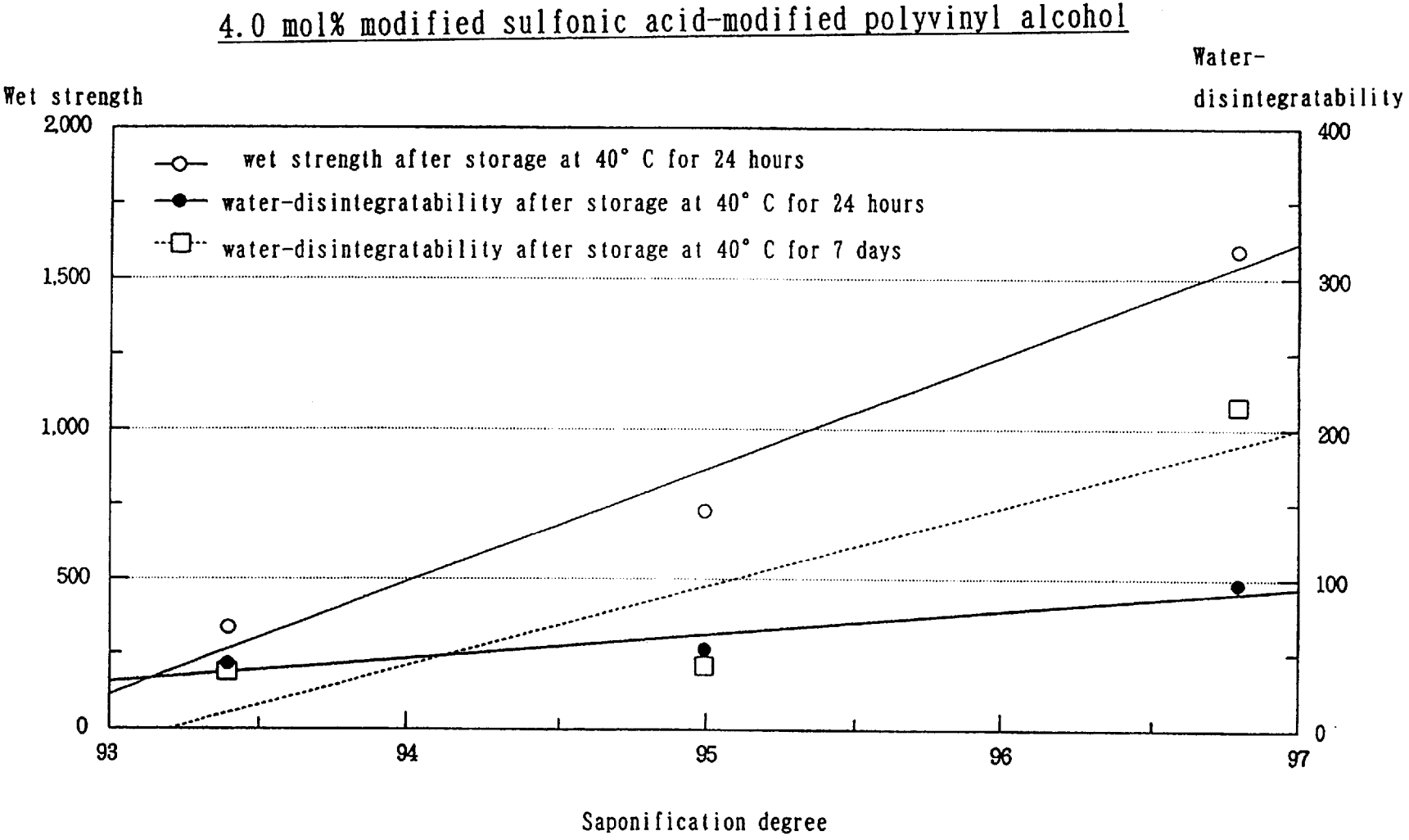
FIG. 3 is a graph showing the relationship of a saponification degree of a 4.0 mol % modified sulfonic acid-modified polyvinyl alcohol with the water-disintegratability and wet strength after storage at 40° C. for 24 hours as well as the water-disintegratability after storage at 40° C. for 7 days in Example 3.

[As for FIG. 3]

FIG. 3 is a graph showing the relationship of a saponification degree of a sulfonic acid-modified polyvinyl alcohol with the water-disintegratability and wet strength after storage at 40° C. for 24 hours as well as the water-disintegratability after storage at 40° C. for 7 days in the results of Example 3 carried out by using a 4.0 mol % modified sulfonic acid-modified polyvinyl alcohol.

From FIG. 3, the following were found in the fibrous sheet of Example 3 using a 4.0 mol % modified sulfonic acid-modified polyvinyl alcohol.

In order to obtain the results of the water-disintegratability being 200 seconds or less and the strength being 1000 g/25 mm after storage at 40° C. for 24 hours, the saponification degree of the polyvinyl alcohol is preferably 95% or more. Also, even when the saponification degree of the polyvinyl alcohol was 97%, the results of the water-disintegratability after storage at 40° C. for 7 days was below 400 seconds.

Figure 4:
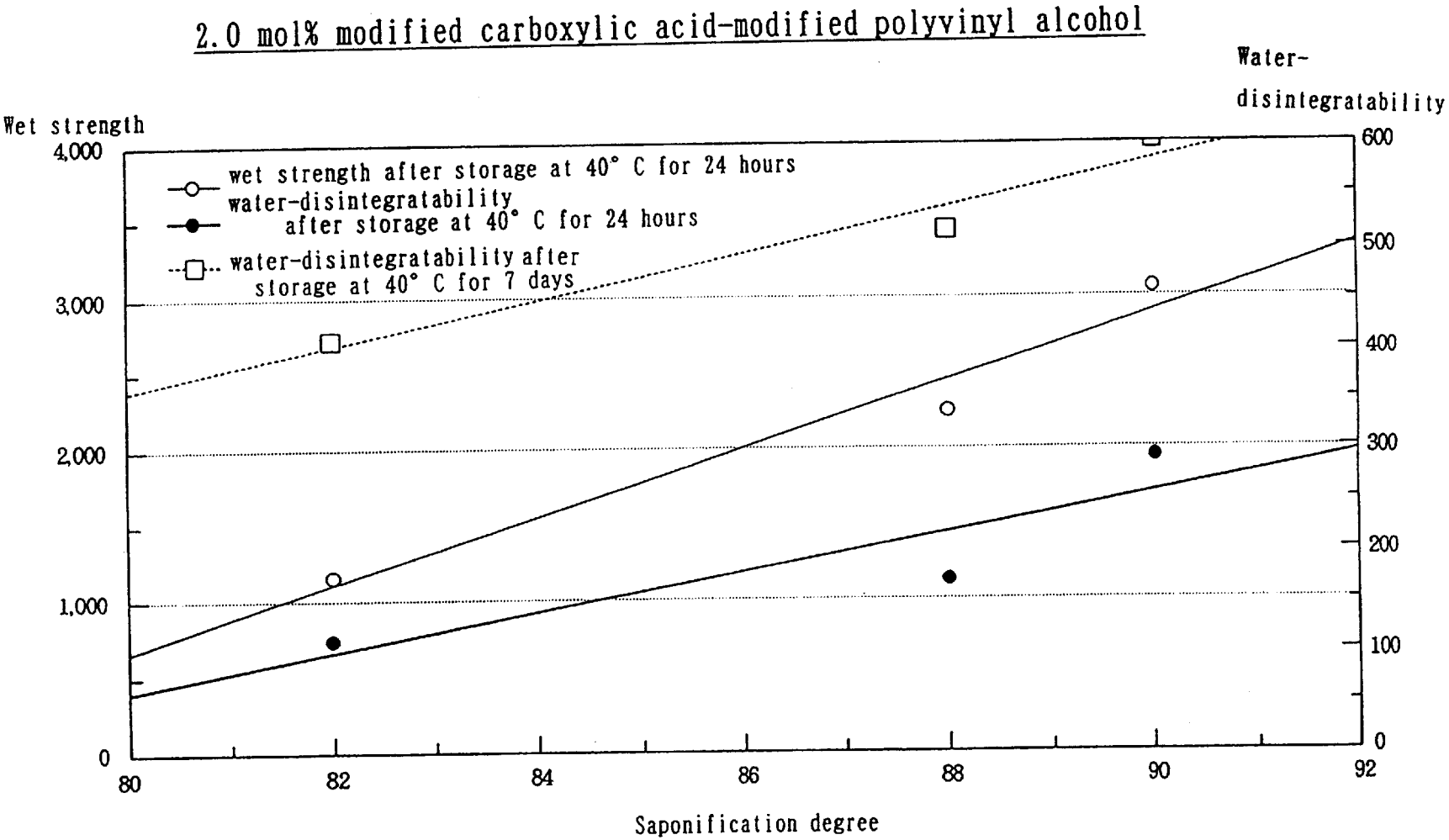
FIG. 4 is a graph showing the relationship of a saponification degree of a 2.0 mol % modified carboxylic acid-modified polyvinyl alcohol with the water-disintegratability and wet strength after storage at 40° C. for 24 hours as well as the water-disintegratability after storage at 40° C. for 7 days in Example 3.

[As for FIG. 4]

FIG. 4 is a graph showing the relationship of a saponification degree of a carboxylic acid-modified polyvinyl alcohol with the water-disintegratability and wet strength after storage at 40° C. for 24 hours as well as the water-disintegratability after storage at 40° C. for 7 days in the results of Example 3 carried out by using a 2.0 mol % modified carboxylic acid-modified polyvinyl alcohol.

From FIG. 4, the following were found in the fibrous sheet of Example 3 using a 2.0 mol % modified carboxylic acid-modified polyvinyl.

In order to obtain the results of the water-disintegratability being 200 seconds or less and the strength being 1000 g/25 mm after storage at 40° C. for 24 hours, the saponification degree of the polyvinyl alcohol is preferably 82% or more. Also, in order to obtain the results of the water-disintegratability being 400 seconds or less after storage at 40° C. for 7 days, the saponification degree of the polyvinyl alcohol is preferably 82% or less.

The saponification degree at this time is preferably 82%.

As described above, in the water-disintegratable fibrous sheet of the present invention, preferred saponification degree is determined based on the modification degree of the modified polyvinyl alcohol. However, the modification degree and the saponification degree fluctuate depending on the amount of the fiber and the kind and amount of the compound to be contained therein. Thus, it is necessary to optionally control the modification degree and the saponification degree.

What is claimed is:

1. A water-disintegratable fibrous sheet comprising water-dispersible fibers, which sheet contains at least one binder consisting of a sulfonic acid-modified polyvinyl alcohol and at least one compound selected from the group consisting of a water-soluble organic salt, a water-soluble inorganic salt and a boron compound being incorporated in the sheet.

2. A water-disintegratable fibrous sheet as claimed in claim 1, wherein the fibrous sheet is in a wet state by impregnating with an aqueous solution containing said at least one compound.

3. A water-disintegratable fibrous sheet as claimed in claim 1, wherein the binder is coated on a web of the water-dispersible fibers.

4. A water-disintegratable fibrous sheet as claimed in claim 1, wherein the water-soluble organic salt is at least one compound selected from the group consisting of sodium tartrate, potassium tartrate, sodium citrate, potassium citrate, sodium malate and potassium malate.

5. A water-disintegratable fibrous sheet as claimed in claim 1, wherein the water-soluble inorganic salt is at least one compound selected from the group consisting of sodium sulfate and potassium sulfate.

6. A water-disintegratable fibrous sheet as claimed in claim 1, wherein the water-soluble boron compound is at least one compound selected from the group consisting of boric acid and borax.

7. A water-disintegratable fibrous sheet as claimed in claim 1, wherein the binder has a saponification degree of 80% or more.

8. A water-disintegratable fibrous sheet as claimed in claim 1, wherein the sulfonic acid-modified polyvinyl alcohol has a modification degree of 1.0 to 10.0 mol %.

9. A water-disintegratable fibrous sheet as claimed in claim 8, wherein the sulfonic acid-modified polyvinyl alcohol has a saponification degree of 80 to 98%.

10. A water-disintegratable fibrous sheet as claimed in claim 1, wherein the sulfonic acid-modified polyvinyl alcohol has a modification degree of 2.0 to 5.0 mol %.

11. A water-disintegratable fibrous sheet as claimed in claim 10, wherein the sulfonic acid-modified polyvinyl alcohol has a saponification degree of 86 to 98%.

12. A water-disintegratable fibrous sheet as claimed in claim 1, wherein the sulfonic acid-modified polyvinyl alcohol has a modification degree of 1.0 to 2.0 mol % and a saponification degree of 84 to 90%.

13. A water-disintegratable fibrous sheet as claimed in claim 1, wherein the sulfonic acid-modified polyvinyl alcohol has a modification degree of 2.0 to 3.0 mol % and a saponification degree of 86 to 95%.

14. A water-disintegratable fibrous sheet as claimed in claim 1, wherein the sulfonic acid-modified polyvinyl alcohol has a modification degree of 3.0 to 5.0 mol % and a saponification degree of 92 to 98%.

* * * * *